United States Patent [19]

Stobbart

[11] Patent Number: 4,903,513

[45] Date of Patent: Feb. 27, 1990

[54] ASSEMBLY FOR RETAINING ARTICLES

[76] Inventor: Brian C. Stobbart, 14 Bedara Court, Robina QLD 4226, Australia

[21] Appl. No.: 273,678

[22] Filed: Nov. 21, 1988

Related U.S. Application Data

[63] Continuation of Ser. No. 45,765, Apr. 28, 1987, abandoned, which is a continuation of Ser. No. 862,213, Apr. 17, 1986, abandoned.

[30] Foreign Application Priority Data

Aug. 22, 1984 [AU] Australia ..... PG6717
Oct. 24, 1984 [AU] Australia ..... PG7797

[51] Int. Cl.[4] ..... E05B 73/00; E05B 73/02
[52] U.S. Cl. ..... 70/422
[58] Field of Search ..... 70/18, 23, 422, 30, 70/49; 312/138 R, 333, 114; 52/98–100

[56] References Cited

U.S. PATENT DOCUMENTS

| | | | |
|---|---|---|---|
| 908,864 | 1/1909 | Hopton | 70/422 |
| 1,066,129 | 7/1913 | Manasse | 70/456 |
| 1,106,072 | 8/1914 | Beach | 70/422 |
| 2,420,125 | 5/1947 | Crist | 70/456 |
| 3,084,008 | 4/1963 | Mallett | 312/333 |
| 3,797,167 | 3/1974 | Gomboc | 49/141 |
| 4,474,116 | 10/1984 | Castenada et al. | 70/63 |

*Primary Examiner*—James L. Ridgill, Jr.
*Attorney, Agent, or Firm*—Nixon & Vanderhye

[57] ABSTRACT

Retaining apparatus for retaining emergency use articles, such as locking means, a key or an alarm switch. The retaining apparatus supports a break glass panel which conceals the emergency use article and the panel is mounted whereby it may be either fractured or released by removal of locking means to provide access to the article.

8 Claims, 5 Drawing Sheets

ASSEMBLY FOR RETAINING ARTICLES

This is a continuation of application Ser. No. 07/045,765, filed Apr. 28, 1987, now abandoned, which is a continuation of 862,213, filed Apr. 17, 1986 also now abandoned.

This invention relates to retaining assemblies.

In particular this invention relates to retaining assemblies for retaining articles which may have to be used or actuated in an emergency. For example this invention may be used for locking fire or stairwell doors or doors for security cabinets containing equipment such as fire extinguishing apparatus or the like. In addition it may be used for locking a valve in an open or closed attitude while permitting emergency operation of the valve. This invention can be used for retaining various articles, including lifesaving equipment, which may be located in an area accessible to the public and which is required to be secured against theft or vandalism while being readily available for use in an emergency. A retaining assembly according to this invention may also be used to retain a key, call phone or a switch.

At present, fire extinguishers and hose reels and the like are frequently mounted in cabinets in areas accessible to the public. They may be mounted either externally of or internally within a building. The doors for such cabinets are usually provided with glass panels which may be broken to provide emergency access to the extinguisher or hose. In such cabinets the hinged door is releasably locked to the side walls thereof so as to allow access for servicing purposes. A disadvantage of this arrangement is that the replacement of glass in a cabinet door is expensive. The door and associated locking mechanism is also expensive to manufacture and install. Furthermore in such prior constructions the glass is broken by being smashed inwards into the cabinet and thus jagged pieces of glass may remain in the cabinet and in the glass supporting surround. These pieces may form dangerous protrusions which may cause injury to persons trying to gain emergency access to extinguishing apparatus or the like within the cabinet.

Fire doors for buildings are fitted with closures biased to hold the fire door in a closed position and with conventional locks to secure the fire door in the closed position. The first arrangement is cumbersome and expensive to install while the second arrangement prevents emergency opening of the doors by persons who do not have the appropriate key. The same disadvantage applies to conventionally locked control means or other apparatus. Conventional locking means are also prone to jamming either through non use or distortion such as may result in an earthquake zone.

This invention aims to provide retaining assemblies which will alleviate the disadvantages associated with the presently available apparatus and which will be reliable and efficient in use. Other objects and advantages of this invention will hereinafter become apparent.

With the foregoing and other objects in view, this invention in one aspect resides broadly in a retaining assembly for retaining an article, said retaining assembly including a body having locating means for said article and a fracturable retaining panel supported by said body whereby it prevents access to said locating means and said panel being supported so that an edge portion thereof may be moved to cause the panel to fracture.

The panel may be supported rigidly at one end in cantilever manner so that its opposite end may be moved to break the panel. Alternatively an abutment may be provided intermediate spaced panel edge suupporting means which holds the panel into engagement with the edge support means. The panel is preferably a glass panel which may be scored to facilitate breakage. For this purpose the score line is preferably arranged adjacent the abutment such that one or either end of the panel adjacent the edge support means may be depressed, causing the panel to bend across the abutment and to break along the score line. Suitably the glass is retained in such manner that upon breaking across the score line, the respective pieces fall freely away from the retaining assembly. The panel may be slidably supported between said edge support means and its limit of travel upon sliding engagement with the edge support means may be determined by a stop in one or both edge support means. Alternatively the panel could abut against an article to be retained to hold the article in a seleced position. Releasable locking means may be provided to prevent release of the unfractured panel from the body. Preferably the locking means is a key operable lock which may be removed to enable the unfractured panel to be removed. This lock may be supported adjacent one edge support means if desired. Furthermore the panel may be arranged for breakage by direct finger pressure or for breakage by pressure applied through a linkage or the like.

In another aspect, this invention resides broadly in a retaining assembly including a body having catch means for retaining securing means and a dislodgable member supported by said body whereby the later prevents release of the securing means from said catch means.

The dislodgable member may be maintained in its operative position by locking means such as a padlock or by a concealed latch or lock which may be spring loaded to engage with the member. Preferably the locking means is releasable whereby the member may be freely removed or forceably dislodged from the body. In one embodiment of this invention the locking member is a cable such as a chain adapted for placement about an article to be secured and the catch means is a jaw in which any selected link of the chain may be secured. Suitably the jaw is associated with a storage well for storing excess chain and preferably the storage well is so made and arranged that in use upon release of the dislodgable member excess chain falls freely from the storage well. The dislodgable member may be associated with an alarm switch arranged to signal release of the member.

The catch means may be a pin or projection for retaining the chain. For this purpose the pin or projection has a free end portion which is spaced closely adjacent the glass panel. When the latter is removed a chain link may be placed about the free end for retention by the pin or projection. Replacement of the glass panel holds the chain captive on the pin or projection as the parts are arranged so that there is insufficient gap between the free end and the panel to allow the link to move from the pin or projection. Preferably the pin or projection is shaped to ensure automatic or free release of a chain link therefrom.

This invention in another aspect resides broadly in a method of supporting a fracturable or dislodgable panel which prevents access to an article, the method including providing a pair of spaced abutment means against which one side of the panel may be supported and providing another abutment means at the other side of the panel and intermediate said spaced pair of abutment means whereby the panel may be fractured or dislodged by bending it about said another abutment means.

In order that the present invention may be readily understood and put into practical effect, reference will now be made to accompanying drawings which illustrate typical embodiments of the present invention, wherein.

Figure 1:
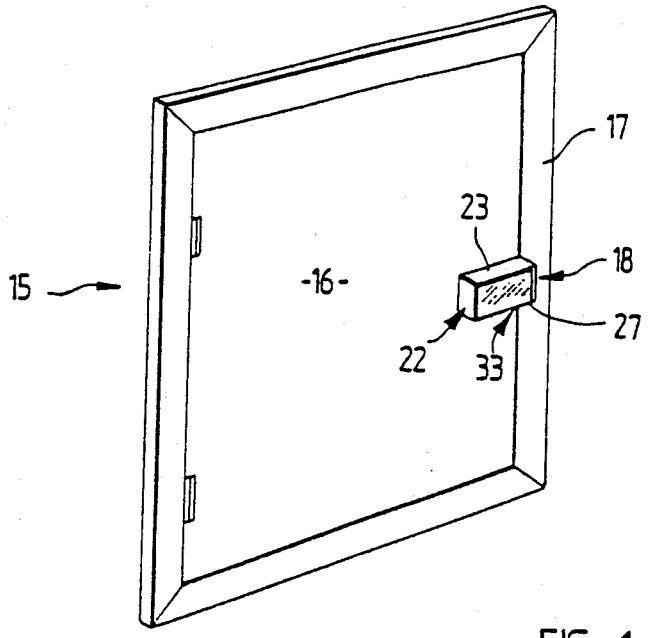
FIG. 1 illustrates a door assembly held in the locked position by one form of retaining means.
Figure 4:
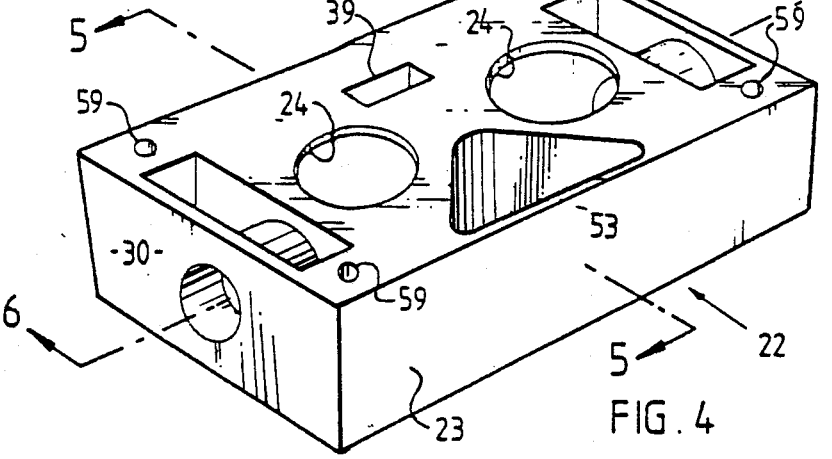
FIG. 4 is an underneath perspective view of the body of the retaining assembly.
Figure 5:
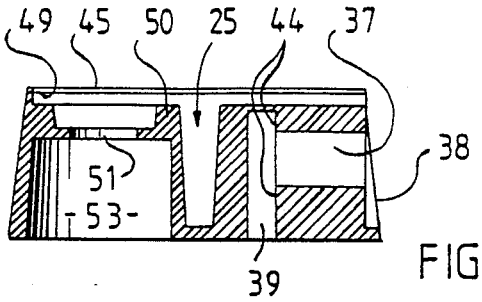
Figure 6:
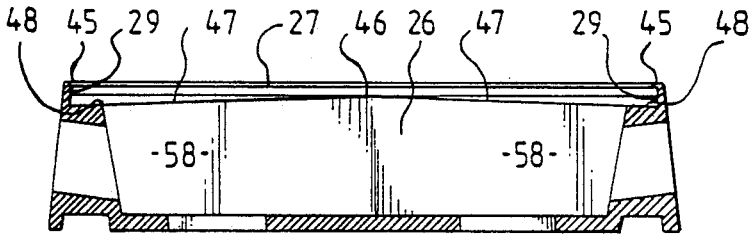
Figure 7:
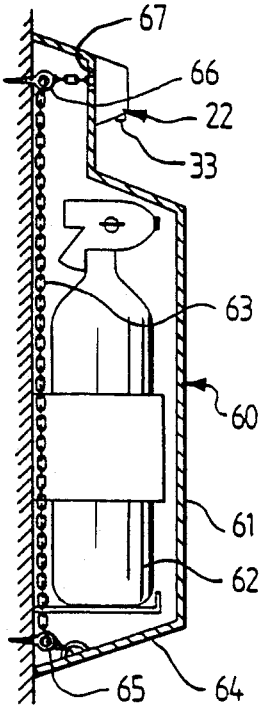
Figure 8:
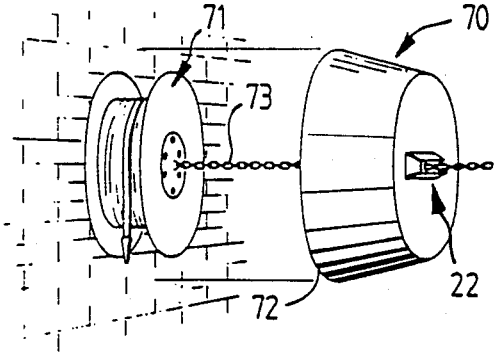
Figure 9:
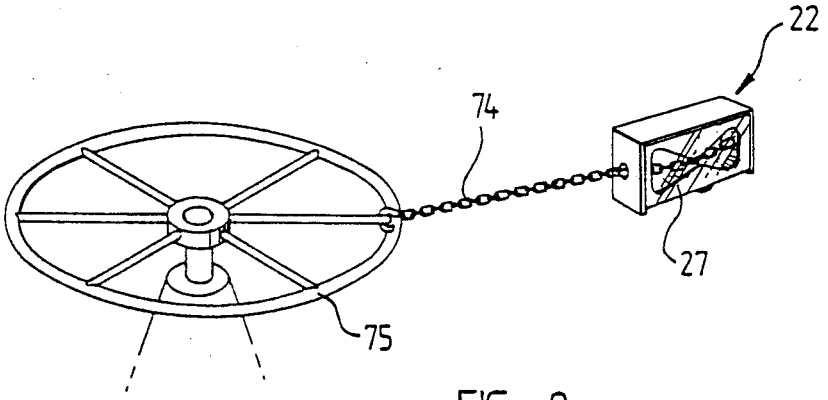
Figure 10:
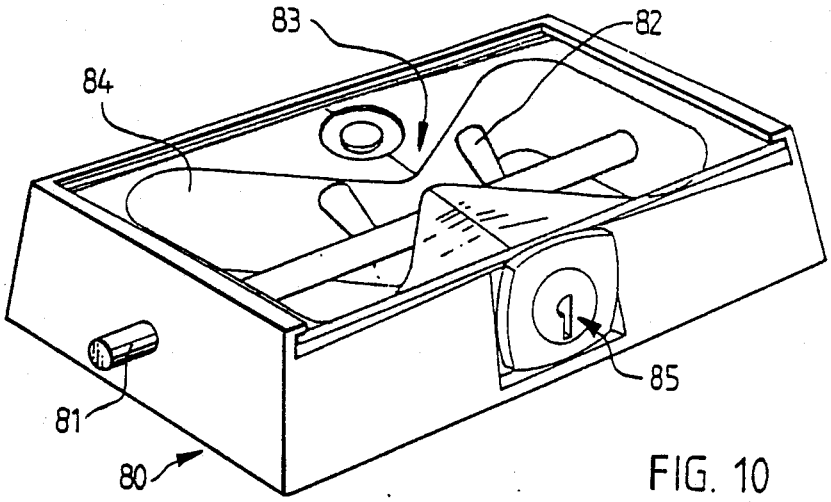
Figure 11:
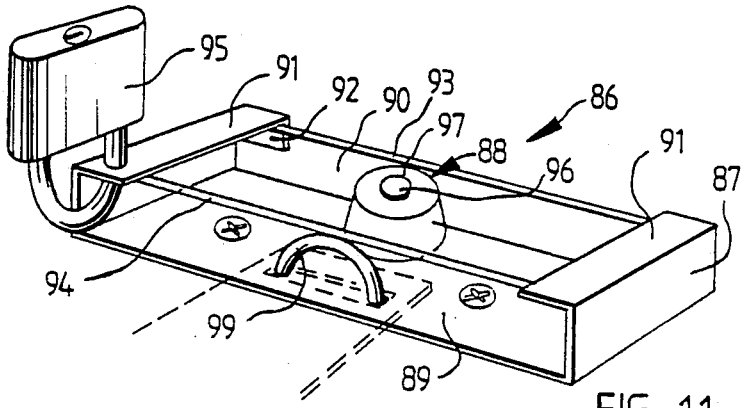

FIGS. 5 and 6 are cross-sectional views taken along the lines 5—5; and 6—6 of FIG. 4 respectively;

FIG. 7 illustrates the retaining assembly adapted to retain a fire extinguisher;

FIG. 8 illustrates the retaining assembly adapted to retain a fire hose reel;

FIG. 9 illustrates the retaining assembly adapted to retain an operating wheel;

FIG. 10 illustrates a modified form of the retaining assembly shown in FIG. 1;

FIG. 11 illustrates a simplified form of the invention, and

Figure 12:
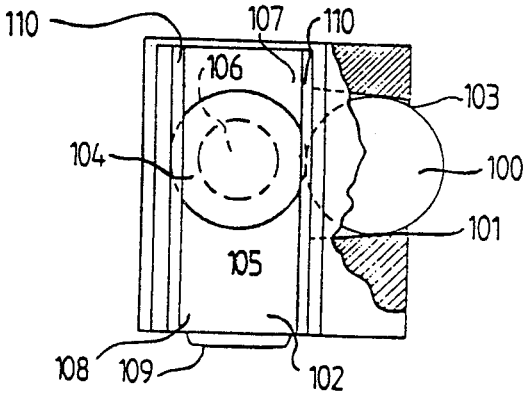

FIG. 12 illustrates a further embodiment of the invention.

Figure 2:
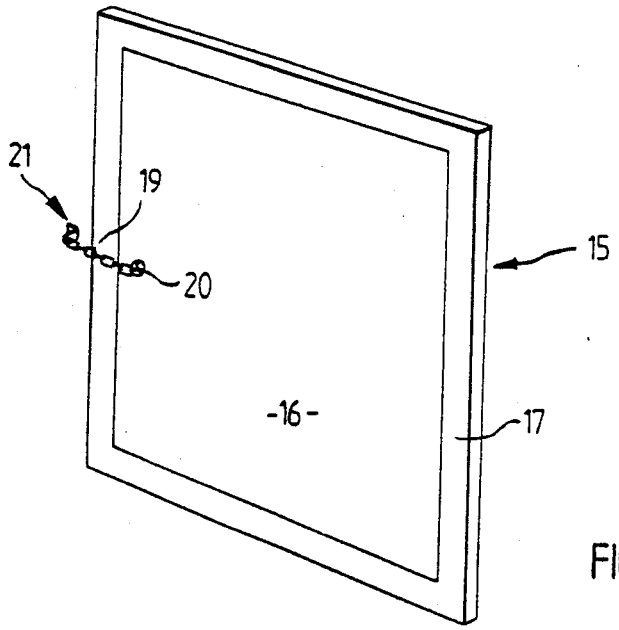
FIG. 2 is a rear view of the door assembly.

FIGS. 1 and 2 illustrate a door assembly 15 comprising a door 16 mounted hingedly in a door surround 17 and secured in the shut position by a locking assembly 18. The latter includes a chain 19 which passes through an aperture 20 in the door 16 from a shielded screw-in mounting assembly 21 to a retaining assembly 22 in which the chain is retained. The retaining assembly 22 may engage with a selected chain link so as to maintain the chain relatively tight and the door secured in the closed position. The excess chain 19 may be stored in the retaining assembly 22.

Figure 3:
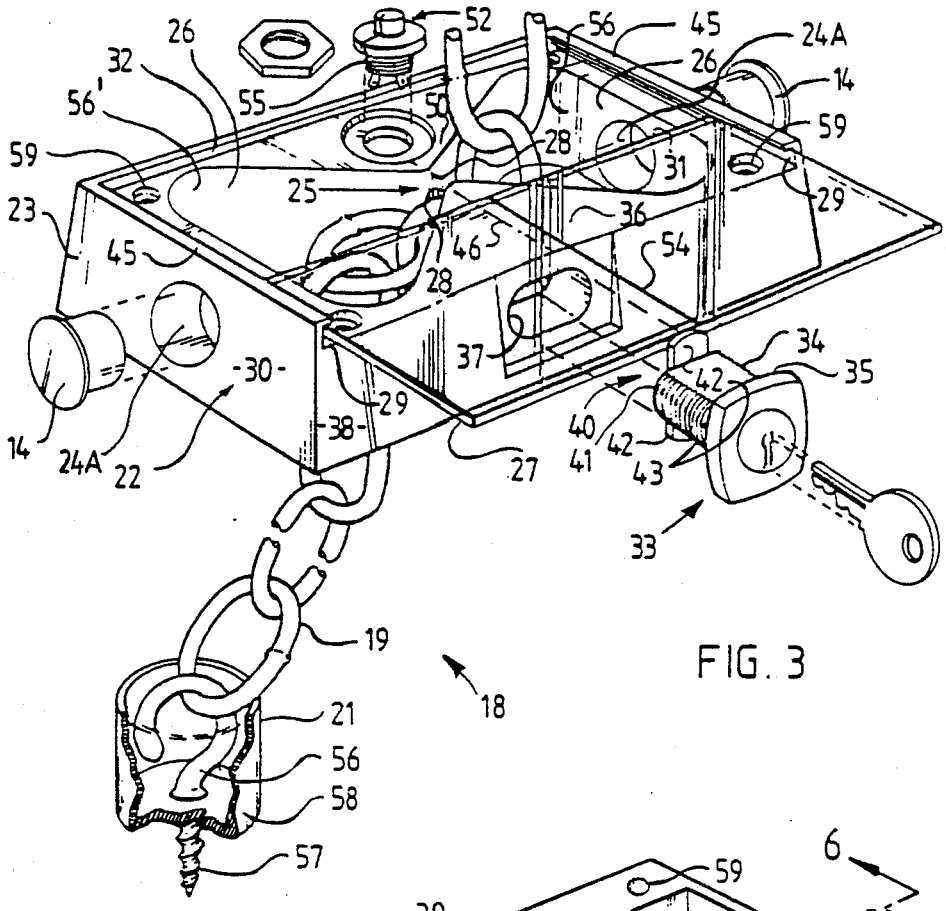
FIG. 3 is an exploded perspective view of the retaining assembly illustrated in FIG. 1.

In order to provide a suitable chain passage through the door aperture 20, the back of the mounting assembly could be formed with a tubular protrusion adapted to pass through the door aperture 20 to provide a fixed guide for chain. This protrusion could be formed integrally with the retaining assembly 22 or separate as desired. The locking assembly 18 is illustrated in FIG. 3. It includes the retaining assembly 22 which may be formed of metal or a plastics material and having a mounting body 23 provided with an inlet aperture 24 through which the chain 19 may lead to a fixed jaw assembly 25 in which any selected chain link may be secured between the jaws 28. A retaining well 26 is provided at each side of the jaw assembly 25 and an inlet aperture 24 is provided in the base at each well 26 so that the chain may be introduced to the body 23 from either side of the jaw assembly 25.

The excess chain 19 is stored in the well 26 opposite the chain inlet aperture 24 and a glass retaining panel 27 is slidably received between opposed guide channels 29 formed in the body 23 above the respective end walls 30 to enclose the wells 26. The leading longitudinal edge 31 of the panel 27 abuts the side wall 32 when it is secured in position by the cam-lock assembly 33. When so secured the panel 27 is prevented from withdrawal by the outer retaining flange 35 of the lock assembly 33 which extends outwardly beyond the top face 36 of the body 23. The lock assembly 33 is secured by inserting the flat sided barrel 34 of the lock assembly 33 into a correspondingly shaped recess 37 which extends from the front wall 38 to a rear cavity 39 and by subsequent key rotation of the retaining cam 40 from its unlocked position at which it is concealed by the end 41 of the barrel 34 and thus insertable in the recess 37, to its locked position at which the cam ends 42 extend outwardly beyond the flats 43 and engage behind the inner end face 44 of the recess 37.

As can be clearly seen in FIG. 6, the top face 36 of the body 23 is not planar. It includes a central raised or abutment portion 46 and inclined side portions 47 which slope to the respective bases 48 of the guide channels 29. This arrangement is provided so that the glass panel 27 is held by the central raised or abutment portion 46 in spaced relationship with the inclined side portions 47, and against the inner faces 49 of the retaining flanges 45 which form the guide channels 29. The latter are sufficiently deep that the glass panel 27 may be easily broken for removal by depressing either one or both of its ends adjacent the flanges 45 to cause it to bend about the abutment and fracture. The glass panel 27 may be provided with a central score line 54 on its outer face above the central abutment 46 to facilitate breakage. Alternatively it may be provided with a nick in one edge adjacent the abutment 46 to form a weakened zone at which a break will commence.

It will be seen that the top wall 50 of the jaw 28 opposite the lock recess 37 is recessed and apertured at 51 to enable a push button switch assembly 52 to be secured thereto with its body 55 retained in the rear access well 53. The button is released to switch to operative mode. It is normally held in the depressed attitude by the panel and in the inoperative mode 27. Upon breakage of the panel 27 the button is released and a suitable alarm, which may be mounted remote from the body or in the body 23 is activated.

The unfractured panel 27 can be unlocked and removed for normal servicing of equipment secured by the retaining assembly 22 by releasing the lock 33 from the body 23 and sliding the panel 27 from the guide channels 29. The chain can then be released. Since the chain is held in the jaws an eyebolt type connection can be utilized for retaining the end of the chain remote from the body 23 since the chain cannot be rotated to enable the eye bolt to be undone. Of course many other forms of termination may be used for the remote end of the chain. As illustrated in FIG. 3 the end of the chain 19 is hooked over an open hook 56, the shank 57 of which passes through a cup 58 which closely accommodates the hook 56 to prevent removal of the chain link therefrom.

The side walls 56' of the wells 26 slope so that when the retaining assembly 22 is supported on a vertical surface and the panel 27 is released the tail end of the chain will fall therefrom so that it can be gripped and pulled to disengage the chain from between the jaws 28 or so that it will automatically disengage from the jaws assembly 25. The chain 19 is then free to slide through the aperture 24 to release the article retained thereby. Of course the size and shape of the chain retaining well 26 can be varied as desired and the jaws could be in the form of movable or fixed cleats such as cam-cleats or clam-cleats adapted to retain a tensioned cable such as a rope in lieu of the chain illustrated. Further apertures 24A are provided in the end walls 23 of the body for side entry of the cable. End plugs 14 may be provided to blank off the apertures 24A. Mounting apertures 59 extend through the body 23 and are provided for screwing the body 23 to a wall or the like.

Preferably the glass panel 27 is a dark coloured panel so that it conceals the chain and alarm button and the body 23 is a contrasting light colour such that in use a missing panel will be noticed. The panel 27 may be provided with operating instructions and designated pressure areas to by pressed to fracture the panel 27. For this purpose scored panels can be marked "PRESS" to indicate a simple press to break assembly and unscored panels can be marked "SMASH" to indicate that the panel has to be smashed with any suitable means to free it from the body 23. In use, since the panel is retained only by the flanges 45 it will fall freely from the body when fractured whereby it will not inhibit access to the chain 19 the tail of which will fall to hang freely for grasping and pulling from the jaws 28.

In a fire door installation in which the door leads to a stairwell, for example, the anchor means may be an open eye mounted in the stairwell so that firemen or other persons can release the chain from the eye to open the door from inside the stairwell. Thus the door is locked from the outside and able to be opened in an emergency from either side. Alternatively a retaining assembly 22 according to the present invention may be used at each side of the door to secure a retaining chain therebetween. The mounting assemblies could be mounted on the fixed jambs at opposite sides of a door or one mounting assembly could be mounted on the door and one on the jamb adjacent the opposite side of the door. If desired the retaining assembly could be partially supported within a door. For this purpose a slim face plate could be provided to support the glass panel. This face plate could extend externally of the door while the chain storage could be concealed in the door.

FIG. 7 illustrates a fire extinguisher concealment 60 comprising an open backed housing 61 which may be fitted about the fire extinguisher 62 and held in place by a chain 63 which passes from the base 64 of the housing 61 through an adjacent eye bolt 65 to a further eye bolt 66 adjacent the top of the housing and then through an aperture 67 therein which coincides with an aperture 24 of a retaining assembly 22 of the type described with reference to FIGS. 1 to 6. The housing 61 can be removed upon release of the chain 63 from the retaining assembly 22 by either breaking the glass panel 27 or unlocking the lock 33 and slidably removing the panel 27.

FIG. 8 illustrates a similar concealment 70 for a fire hose reel assembly 71. Again a housing 72 is provided with a retaining assembly 22 as described with reference to FIGS. 1 to 6 and co-operable with a chain 73 fixed to the hose reel assembly 71. Of course in either of the above concealments, the retaining assembly could be formed integrally with the housing and the alarm switch 51 could be connected to a remote alarm or an alarm supported in the housing 72 together with a suitable power supply. Furthermore this type of concealment could be utilized to conceal a handle of an unlocked fire door latch set without modifying the door. For this purpose the locking chain is formed with a loop at one end which may be tighetened about the base of the handle. The other end of the chain is secured in the retaining device of the concealment which is adapted to abut the door jamb to locate non-rotatably about the handle to conceal same and prevent opening of the door except in an emergency.

FIG. 9 illustrates a further application of the retaining assembly 22. In this application the locking chain 74 passes to an acutating wheel 75 or a valve assembly 76 or the like. This wheel 75 cannot be rotated unless the chain is freed. Thus it can be acutated by authorised operators by key release of the panel and freeing of the chain or by anyone in an emergency by breaking the panel 27 and freeing the chain 74. If a more secure retention of the wheel or other article is required the chain 74 could pass from the base of an eye bolt secured to an adjacent fixture about the wheel rim and back through the eye of the eyebolt to the retaining assembly 22. In this arrangement the eyebolt cannot be rotated and thus forms a secure lock mounting for the article. p In the embodiment illustrated in FIG. 10 there is provided a similar retaining assembly 80 supporting a slide bolt 81 which is reciprocally mounted therein. The slide bolt 81 has a pair of actuating handles 82 which have to be raised for passage between the central jaws 83 in order to retract the bolt 81. The length of the handles 82 is such that they cannot be elevated to their raised position when the glass panel 84 is in place. Thus any article retained by the bolt 81 will be secured until the glass panel 84 is removed by being broken or unlocked and withdrawn by release of the lock assembly 85.

FIG. 11 illustrates an embodiment of the invention formed from sheet metal or the like. In this embodiment the retaining assembly 86 includes a channel shaped body part 87 which supports a switch assembly 88 of its base 89. The switch assembly extends upwardly to form an abutment for the underside of a glass panel 90. The latter is retained at its opposite edge portions by top flanges 91 which abut the outer side of the panel 89. A stop 92 is folded from one flange 91 to retain one edge 93 of the glass panel 90 and the other edge 94 of the glass 90 is retained by a removable padlock 95. The button 96 of the switch assembly 88 is held in the inoperative position by the glass 90 and the latter is provided with a score line 97 above the button 96. A staple 99 may be provided fixed to the base 89 and adapted to receive a hasp (shown in dotted outline) for securing a selected article. The arrangement is such that the hasp cannot be removed unless the glass is removed either by force, such as by breakage or by removing the padlock 95. Also a hook and eye or other co-operating securing assemblies could be used in lieu of the hasp and staple described.

This basic embodiment may be modified by the use of pressed out stiffening members or jaw members or the like. For this purpose the button assembly may be replaced by a pressed out jaw which also acts as an abutment to retain the glass in abutment with the underside of the flanges 91. Also in lieu of the stop, the bracket may be placed adjacent an article to be removed so that the edge 93 of the glass panel 90 abuts the article to prevent removal of same unless the panel is removed or broken. Container walls for chain or other articles may also be folded from the base. Also a slide bolt or the like could be mounted on the base in lieu of the switch 88 and arranged beneath the score line 97 to provide the abutment across which the glass may be broken. The actuating handle of the slide bolt would be concealed by the glass panel as illustrated in FIG. 10.

In the embodiment illustrated in FIG. 12, a ball 100 is retained in the tapered passage 101 of a body 102 such that a minor portion of its outer surface extends through an apeture 103 having a diameter less than the ball diameter. A second ball 104 is normally held in position between the ball 100 and a side wall 105 such that the ball 100 cannot be retracted by force through the aperture 103. The second ball 104 is located in a recess 106 in the floor 107 of the body 102 and a glass panel 108 is retained by suitable locking means 109 in position above and in abutting relationship with the second ball 104 to hold it located in the recess 106. Upon breakage of the glass 108 the second ball 104 can fall from its recess 106 to enable the ball 100 to retract through the aperture 103 into the body 102. In order to prevent the ball 104 falling away from the body 102, suitable inwardly projecting flanges 110 are provided beneath the glass panel 108. The lock assembly 109 retains the glass panel 108 removably in the body 107. In use the body 102 is inclined such that the ball 104 will automatically roll from the recess 106 when the retaining glass is broken across the ball 100. The glass may be scored for this purpose if desired. The protruding portion of the ball 104 can be used as an abutment for locking any suitable article in place.

This invention may also be utilized as a manual call point. For this purpose a retaining device similar to that shown in FIG. 3 is used, however the size of cavity in the rear of the body 23 is increased to contain the necessary wiring and the front recess is made to contain a fire door key or the like which is concealed by the panel 27. Upon breaking this panel the fire alarm is switched on by release of the push button switch 52 and the key is accessible.

The dislodgable member which may be forceably removed by being fractured for release from the body or forceably dislodged therefrom may be a plastic panel or other elastic member adapted to be deformed for release from the body of the retaining assembly or it may be scored or provided with a V-groove to facilitate breakage thereof and the panel could be arranged to fracture into more than two portions if desired. The dislodgable member is preferably adapted to be freely removed from the body upon release of the locking means so that authorised personnel or servicemen may gain access to the locating means.

It will of course be realised the above has been given by way of illustrative examples of this invention and that all such and other modifications and variations thereto as would be apparent to persons skilled in the art are deemed to fall within the broad scope and ambit of the present invention as is defined in the appended claims.

I claim:

1. A retaining assembly, comprising:

a body having a wall assembly;

a passage extending through said body for allowing a retaining cable to pass into said body;

holding means in said body for manually engaging said cable and for preventing retraction of said cable through said passage;

an open storage recess in said body in which a tail portion of said cable engaged in said holding means may be stored;

a fracturable panel slidably retained by said body, said panel being slidable from a covering position at which said panel extends across said open storage recess and said holding means to a disengaged position at which said open storage recess and said holding means are uncovered to provide access thereto, said panel being fracturable to provide access to said holding means and said recess; and releasable locking means engageable with said body for preventing sliding of said panel to said disengaged position and releasable for enabling the unfractured panel to be removed from said body.

2. A retaining assembly according to claim 1, wherein said body supports an alarm switch which is maintained in an inoperative mode by said panel and which changes to an operative mode upon disengagement of said panel from said body.

3. A retaining assembly according to claim 1, wherein said panel is retained beneath spaced flanges and is held in abutting relationship with said flanges by an abutment about which said panel may be bent to cause it to fracture.

4. A retaining assembly according to claim 3, wherein said cable is flexible link chain and said holding means is a jaw assembly in which a chain link may be engaged to secure the chain.

5. A retaining assembly according to claim 4, wherein said jaw assembly forms a cable inlet to said recess.

6. A retaining assembly according to claim 3, wherein said panel is provided with panel weakening means coincident with said abutment for weakening said panel.

7. A retaining assembly according to claim 3, wherein said panel is a substantially rectangular glass panel and said abutment comprises a ridge extending substantially parallel to opposed edges of said panel.

8. A retaining assembly according to claim 6, wherein said panel weakening means is a score line across said panel.

* * * * *